US007954269B2

(12) United States Patent
Laney et al.

(10) Patent No.: US 7,954,269 B2
(45) Date of Patent: Jun. 7, 2011

(54) MUZZLE LOADING RIFLE WITH BREECH PLUG HAVING GAS SEAL FACILITY

(75) Inventors: Mark C. Laney, Lee, NH (US); Gene L. Garland, New Durham, NH (US)

(73) Assignee: Thompson/Center Arms Company, Inc., Springfield, MA (US)

( * ) Notice: Subject to any disclaimer, the term of this patent is extended or adjusted under 35 U.S.C. 154(b) by 0 days.

(21) Appl. No.: 12/883,510

(22) Filed: Sep. 16, 2010

(65) Prior Publication Data

US 2011/0005116 A1 Jan. 13, 2011

Related U.S. Application Data

(62) Division of application No. 11/334,002, filed on Jan. 17, 2006, now Pat. No. 7,814,694.

(51) Int. Cl.
*F41C 9/08* (2006.01)

(52) U.S. Cl. ..... 42/51; 89/26

(58) Field of Classification Search ..... 42/51; 89/1.3, 89/26

See application file for complete search history.

(56) References Cited

U.S. PATENT DOCUMENTS 4,854,065 A 8/1989 French et al.
5,044,278 A * 9/1991 Campbell ..... 102/202.8
5,133,143 A * 7/1992 Knight ..... 42/51
5,561,934 A * 10/1996 Knight ..... 42/51
5,615,507 A 4/1997 French
5,639,981 A 6/1997 French
5,680,722 A 10/1997 French et al.
5,737,863 A * 4/1998 Rainey, III ..... 42/51
5,782,030 A 7/1998 French
5,907,920 A 6/1999 Laney
6,145,235 A 11/2000 Emerson et al.
6,219,951 B1 4/2001 Cate
6,532,692 B2 3/2003 Cate
6,604,311 B1 8/2003 Laney et al.
6,834,455 B2 12/2004 Burigana
7,140,138 B1 11/2006 Laney et al.
7,257,917 B1 8/2007 Garland
7,316,092 B2 * 1/2008 DeLeeuw ..... 42/51
2006/0248771 A1 11/2006 Richards
2007/0137084 A1 6/2007 Laney et al.
2007/0163162 A1 7/2007 Laney et al.

* cited by examiner

*Primary Examiner* — Stephen M Johnson
(74) *Attorney, Agent, or Firm* — McCormick, Paulding & Huber LLP

(57) ABSTRACT

A muzzle loading firearm has a barrel with a bore on a bore axis, and the barrel has a muzzle end and a breech end. A frame is connected to the barrel, and has a breech face. The frame moves between an open position in which the breech face is away from the breech end of the barrel, and a closed position in which the breech face abuts the breech end of the barrel. A breech plug is removably attached to the barrel. The breech plug including a seal element closely received by the bore. The seal element may be a set of piston rings that are received in a circumferential groove about a forward end of the plug, or may be a cup at the forward end, with a forward rim that flares under pressure to provide a gas seal.

15 Claims, 5 Drawing Sheets

MUZZLE LOADING RIFLE WITH BREECH PLUG HAVING GAS SEAL FACILITY

CROSS REFERENCE TO RELATED APPLICATION

This application is a divisional application of U.S. Ser. No. 11/334,002, filed Jan. 17, 2006, now U.S. Pat. No. 7,814,694, entitled "MUZZLE LOADING RIFLE WITH BREECH PLUG HAVING GAS SEAL FACILITY", and is hereby incorporated by reference in its entirety.

FIELD OF THE INVENTION

This invention relates to firearms, and more particularly, to muzzle loading firearms.

BACKGROUND AND SUMMARY OF THE INVENTION

Muzzle loading rifles have an essentially closed breech at the rear of the barrel, so that powder and bullets must be loaded at the muzzle or forward end of the barrel. A typical muzzle loading rifle has a barrel with a breech plug attached to occupy an enlarged rear bore portion of the barrel at the breech end. In some rifles, the breech plug is permanently attached. In others, the breech plug is removable to facilitate pass-through cleaning of the bore.

An existing removable breech plug employs a finely threaded body that screws into the rear of the barrel, with 10-15 turns to secure it in place. This provides safety against hang fires and facilitates removal for cleaning. However, the fouling associated with muzzle loading rifles can clog the threads as gases and particles are forced into the threads during firing, this can freeze up the plug, and require undesirability great torque to remove the plug, through the many rotations required.

The present invention overcomes the limitations of the prior art by providing a muzzle loading firearm. The firearm has a barrel with a bore on a bore axis, and the barrel has a muzzle end and a breech end. A frame is connected to the barrel, and has a breech face. The frame moves between an open position in which the breech face is away from the breech end of the barrel, and a closed position in which the breech face abuts the breech end of the barrel. A breech plug is removably attached to the barrel. The breech plug including a seal element closely received by the bore. The seal element may be a set of piston rings that are received in a circumferential groove about a forward end of the plug, or may be a cup at the forward end, with a forward rim that flares under pressure to provide a gas seal.

DETAILED DESCRIPTION OF A PREFERRED EMBODIMENT

Figure 1:
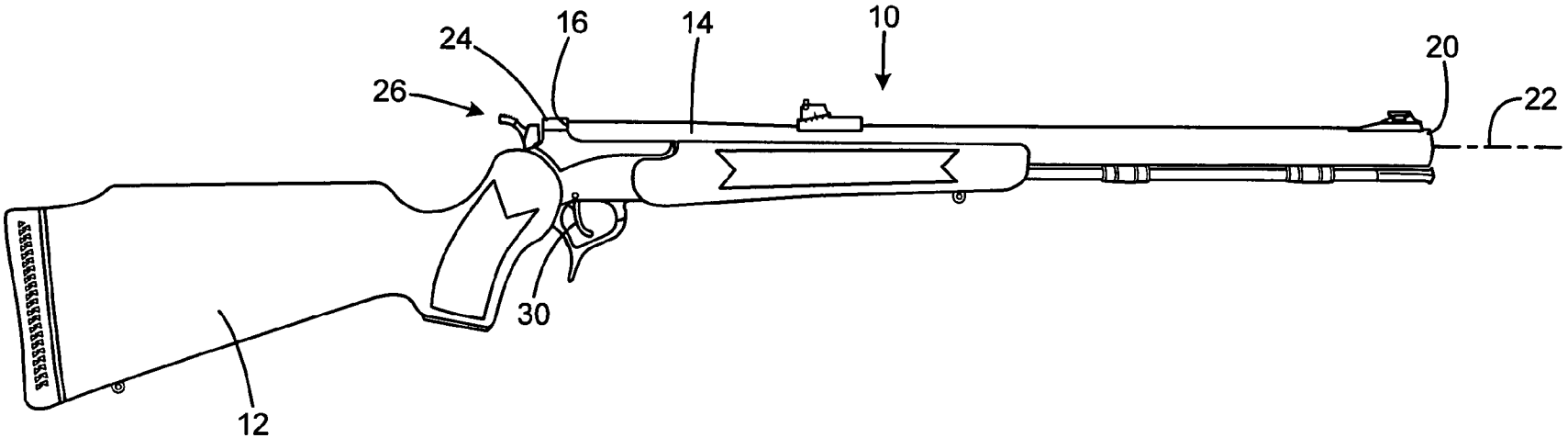
FIG. 1 is a side view of a firearm according to a preferred embodiment of the invention.

FIG. 1 shows a muzzle-loading firearm 10, with stock 12 and a barrel 14 having a breech end 16 and a muzzle end 20, and having a bore defining a bore axis 22. A moveable breech element 24 pivots between an open position and a closed (shown) position. A hammer 26 is pivotally connected adjacent the breech block to operate in response to operation of a trigger 30 as will be discussed below. A muzzle loading firearm having some similar features is disclosed in U.S. Pat. No. 6,604,311 to Laney et al., the disclosure of which is incorporated herein by reference.

Figure 2:
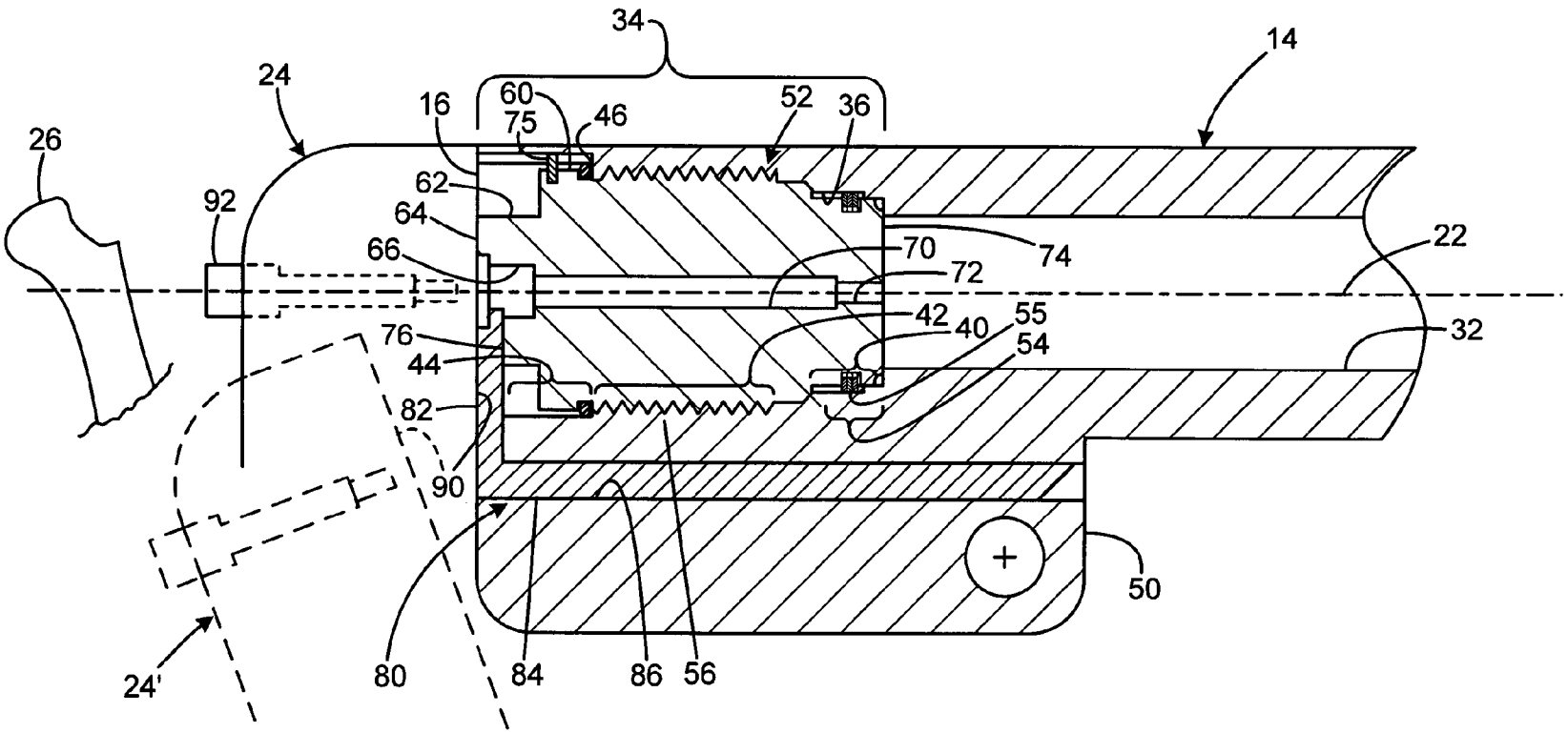
FIG. 2 is a sectional side view of the firearm of FIG. 1.

FIG. 2 shows the breech end 16 of the barrel 14. The barrel defines a rifled bore 32 (rifling not shown) that extends from the muzzle nearly the lengthy of the barrel, except for a rear portion 34. The rear portion of the barrel defines an enlarged breech plug chamber 36 having a stepped initial portion 40, an internally threaded intermediate portion 42, and an enlarged clearance portion 44. A shoulder 46 is formed at the rear end of the threaded portion where it meets the larger-diameter clearance portion 44. A lower lug 50 is integrally connected to a rear portion of the barrel.

The rear portion of the barrel is occupied by a breech plug 52. The breech plug is a generally cylindrical body with a nose portion 54 that is stepped to closely fit in the initial portion 40 of the breech plug chamber 36. Most of the length of the plug is provided with helical threads 56, or an alternative fastening element that provides extreme resistance to axial extraction forces, such as generated by firing a shot. The plug has a flange 60 that is larger in diameter than the threaded portion, and which rests against the shoulder 46 when installed, as shown. The rear or breech end portion of the breech plug has a hexagonal profile portion 62, in the shape of a bolt head that may be engaged by a socket wrench for removing and replacing the plug. A flat rear face 64 of the plug's hex portion is flush with the plane defined by the breech end of the barrel.

The nose portion 54 defines a circumferential groove that receives a set of three metal piston rings 55. The rings provide a tight seal against the sidewall of the breech plug chamber 36, so that threads will be protected against incursion of gas and debris. In an alternative embodiment, also discussed in detail below, a cup seal may be provided, the cup having an cylindrical sidewall extending to an open end in the forward direction and closely received in the chamber, so that the pressure generated by discharge tends to flare the cup, sealing against gases escaping rearwardly.

The breech plug defines a central bore having a primer pocket 66 at the breech end, a flash passage 70 from the primer pocket through most of the length of the plug, and a narrow passage 72 from the flash passage to the nose 74 or forward face of the plug. The primer pocket is generally cylindrical, to fit a standard primer for a muzzle loading rifle, with an enlarged diameter at the rearmost portion to closely accommodate the typical flanged primer. The breech plug includes a pin 75 that protrudes a short distance, radially from the periphery of the flange.

Figure 3:
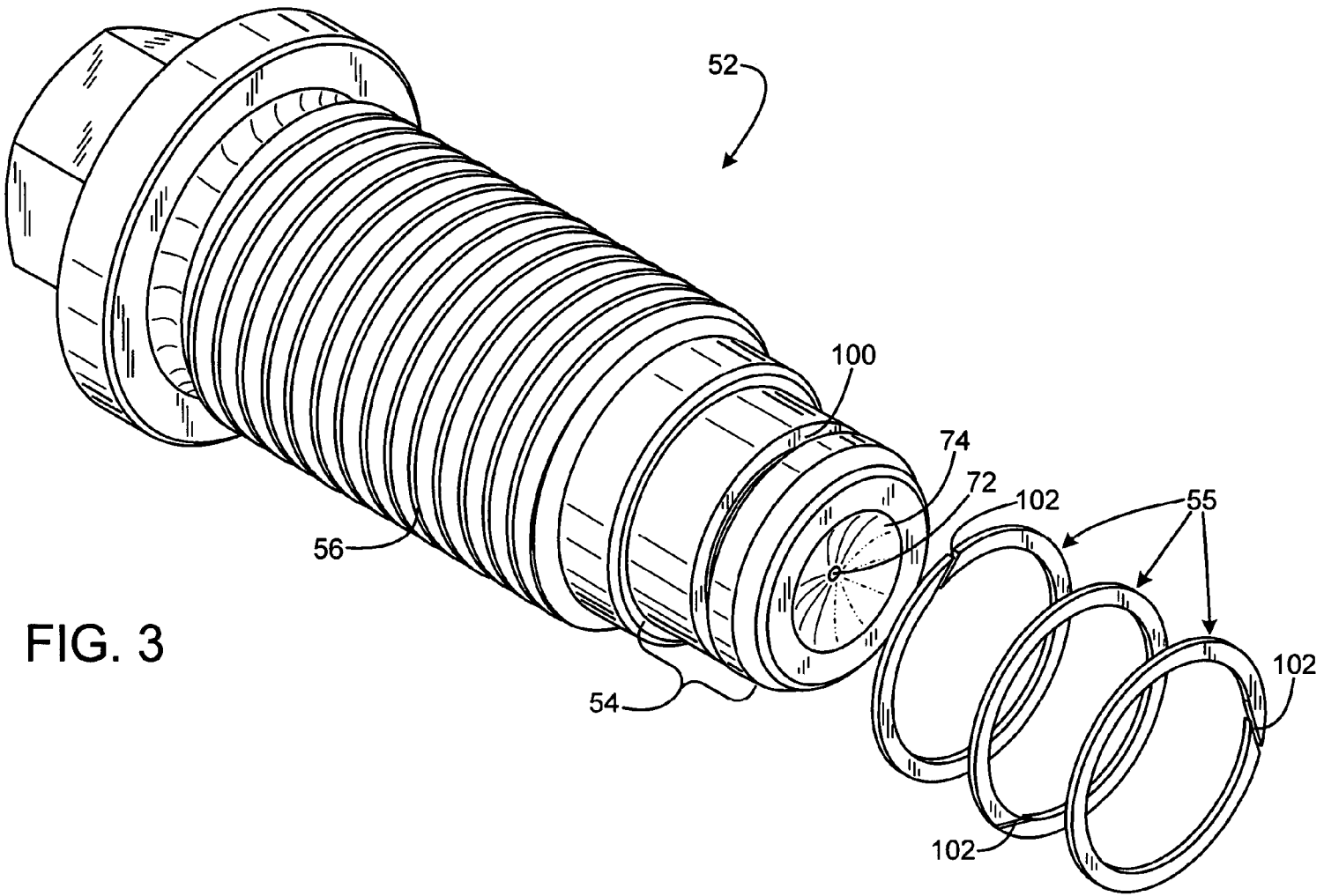
FIG. 3 is a perspective view of a breech plug of the firearm of FIG. 1.

As shown in FIG. 3, the breech plug further defines a rectangular slot 76 that extends downwardly, perpendicularly to the bore axis 22, from the center of the primer pocket. The pin protrudes in the opposite upward direction. The width of the slot is less than the diameter of the flange portion of the primer pocket, and about the same as the diameter of the main portion of the primer pocket. The depth of the slot (along a direction parallel to the barrel axis) is greater than the depth of the flange portion, but less than the depth of the primer pocket overall.

An extractor 80 is a solid body with an L-shaped form. It has a short leg 82 with a rectangular cross section that closely fits the slot 76, and a long leg 84 that has a cylindrical form, and which is closely received in a bore 86 in the lower lug that extends axially, parallel to the bore axis 22. The free end of the short leg of the extractor is formed with a curved lip that partly defines the primer pocket, with the same shape as the surface of revolution that defines the pocket. Thus, when the extractor is in the rest position shown, a primer in the pocket is closely received on all sides without substantial gaps, so that it is physically supported against rupture. Together, the rear face of the extractor leg 82 and the hex face 64 entirely encircle the primer pocket.

The extractor 80 is movable rearward to an extracted position, so that its lip draws a primer in the pocket partially from the pocket, in response to opening of the rifle action, by a linkage (not shown.) The extractor leg 82 inserts in the plug slot only when the plug is in one selected orientation, and prevents plug rotation while in that position. This aids against mis-installation of the plug, and the risk that a plug may work its way out of position during shooting. (or is not installed properly)

The breech element 24 is shown in the closed position in solid lines, and has a breech face 90 that abuts the barrel breech 16 and plug face 64 when closed. This provides a rear surface to fully enclose the primer pocket. A bore in the breech element along the bore axis 22 receives a firing pin 92 that is struck by the hammer 26 to fire the rifle, forcing a tip of the pin into a primer, which sends ignition gases through the plug bore, to ignite gun powder in the barrel. The breech element is shown in the open position (in which the extractor extends to eject the primer) in dashed lines 24'. The extractor is removable to allow removal of the breech plug.

Figure 4:
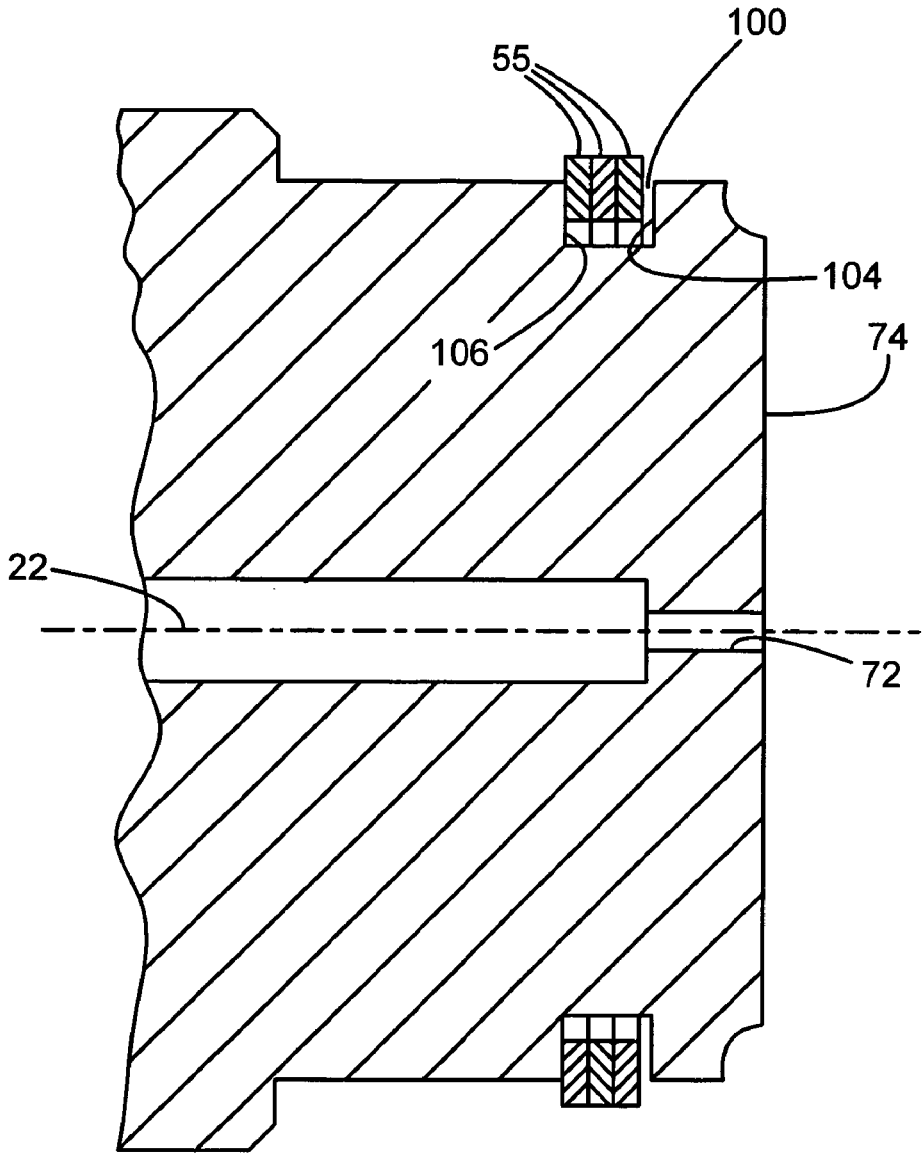
FIG. 4 is an enlarged sectional side view of a breech plug of the firearm of FIG. 1.

As shown in FIG. 3, the breech plug has a circumferential groove 100 at an intermediate axial position on the nose portion 54. The piston rings 55 are arranged with their gaps 102 offset from each other. FIG. 4 shows the rings 55 installed in the groove 100, which has flat front and rear faces 104, 106 that are parallel to each other and perpendicular to the plug axis 22. The groove has a width between the faces of 0.052 inch. The nose portion has a radius of 0.2625 inch, and the groove interior having a radius from the axis of 0.2125 inch. This provides that the groove has a depth of 0.050 inch. The barrel bore has a diameter of 0.531 inch. The rings 55 each have a thickness of 0.015 inch, an outside diameter of 0.531 inch, and an inside diameter of 0.450 inch. These ring dimension are applicable with the rings in a relaxed or untensioned state, in which their gaps 102 are essentially closed. However, to provide for accommodation of slight barrel bore variances, the rings may be provided with a slight gap for bore diameters on the large side, and this gap being closed for bores of minimum diameter.

Accordingly, the dimensions of the groove and rings provide that the stack of three rings is less than the groove width, and the interior of the rings fit loosely on the inner diameter of the groove. This avoids the rings being tensioned open, which would spread their gaps, and allow gases to pass. Also, the looseness allows any eccentricity of the plug thread axis with respect to the bore axis to be tolerated. Further, by the rings being able to shift axially between the rear face and forward face of the groove, the pressure of firing will cause them to abut the rear face, immediately providing a seal that has a strength proportionate to the gas pressure.

The loose rotatabilty of the ring stack with respect to the plug also provides that the rings are not providing excessive friction or suffering excess wear when the plug is screwed in or removed. If the rings were fixed to the plug, a point on the ring would follow a long helical path that corresponded to the total length of the thread. That length would be the circumference of the threaded portion times the number of turns. With the loose rings, the path traveled is less by one or two orders of magnitude, and is only the axial length of the threaded portion. Moreover, the effort of installation is reduced by this feature, because the advantage provided by the screw works to easily overcome the friction provided by the rings' snug fit in the bore.

In an alternative embodiment, the three separate split rings may be replaced by a single multi-turn closely wound helical coil. This is a McFarland-style seal employed in the gas pistons of military rifle actions. This avoids the possible blow-through of gasses via the ring gaps. Such a coil would require that at least the rear face be ground flat and square, so that it provides a seal under pressure against the rear shoulder of the plug groove in which it is received.

Figure 5:
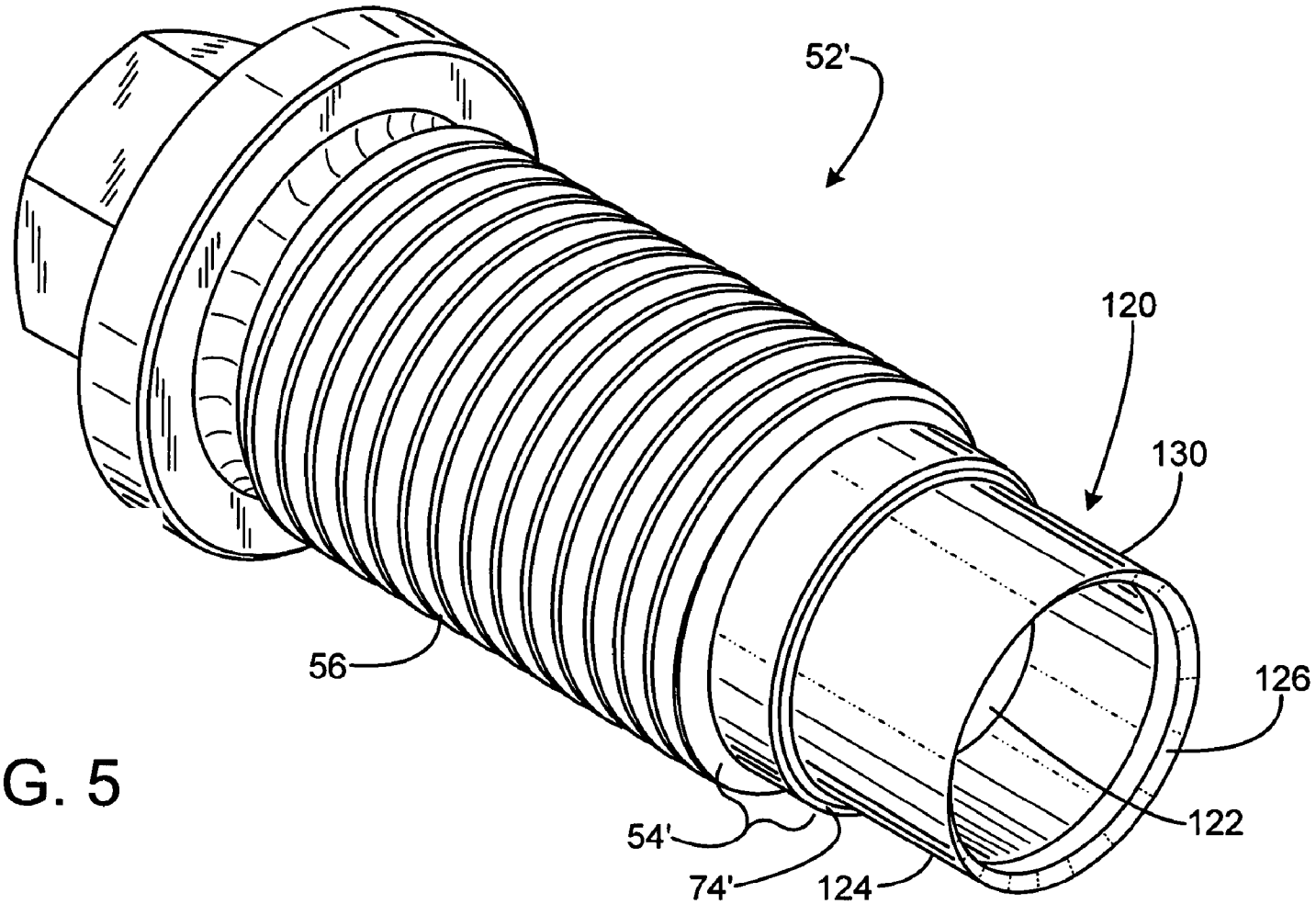
FIG. 5 is a perspective view of a breech plug according to an alternative embodiment of the invention.

FIG. 5 shows an alternative breech plug 52', which is identical to the above breech plug 52, except that is has a different gas seal means at its forward end. Plug 52' has a shorter nose portion 54' as formed in the integral steel plug. However, the plug has an attached cup element 120 attached to the forward face 74' of the plug 52'. The cup has a base 122 that is connected to the nose of the plug, and has a cylindrical side wall 124 that extends forward to a circular free edge 126. The exterior surface 130 is cylindrical and closely fits within the bore of the barrel. The base has an aperture (not shown) to allow communication with the plug's flash hole, and the forward edge 126 is chamfered with a sharp edge, so that pressure from expanding gases tends to expand the cup, flaring it outward to provide a robust seal against gases that might otherwise escape reward toward the plug threads. Essentially, gas pressure within the cup serves to flare the cup outward, as does the pressure-reducing Bernoulli effect of any high-velocity gases in any initial small gap between the cup exterior 130 and the bore.

The cup is attached to the plug by a press friction fit. The breech plug has a boss turned on the forward end with an annular groove to accept a mating receptacle in the sealing cup.

In the preferred embodiment the cup is formed of a soft material such as brass, but it may be formed of any of a wide variety of materials that can withstand the heat and pressure of firing, and provide the flexibility for an effective seal. High temperature polymer composites such as those in the polyethylene family of plastics and PTFE and its variants are believed to be suitably robust and flexible. The use of either a cup or piston rings is intended for firearm barrels that lack rifling, or those with rifling that does not extend fully to the breech of the barrel.

While the above is discussed in terms of preferred and alternative embodiments, the invention is not intended to be so limited. For instance either seal type may be used in conjunction with alternative breech plug attachment methods, including multistart threads, interrupted threads, and rifle bolt concepts.

What is claimed is:

1. A muzzle loading firearm, comprising:

a barrel having a muzzle end and a longitudinal bore extending rearward from said muzzle end to a rear barrel portion with a breech plug chamber, said breech plug chamber having a rear end and an opposing forward end, an internally threaded engagement portion adjacent said rear end and an initial portion forward from said internally threaded engagement portion; and a breech plug having a one-piece, integral body with an outer peripheral surface and adapted to be received in said breech plug chamber, said breech plug body having a nose facing said longitudinal bore, a breech end opposite said nose, a cup element adjacent said nose and a threaded engagement portion adjacent said breech end, said threaded engagement portion engaging said internally threaded engagement portion of said breech plug chamber, said cup element being a deformable seal element in the shape of a circular wall, said deformable seal element being compressed from a first position having a first outside diameter to a second position having a second outside diameter when said breech plug is secured in said breech plug chamber, said second outside diameter being less than said first outside diameter and substantially coextensive with a diameter of said initial portion, to thereby form a gas seal to prevent fouling of said threaded engagement portion during firing.

2. The firearm of claim 1, wherein the circular wall having a length being less than one quarter an over all length of said breech plug body.

3. A breech plug for a muzzle loading firearm having a barrel with a muzzle end and a longitudinal bore extending rearward from said muzzle end to a rear barrel portion with a breech plug chamber having an initial portion having a tapered section, said breech plug comprising: a breech plug having a one-piece, integral body with an outer peripheral surface and adapted to be received in said breech plug chamber, said breech plug body having a nose adapted to face said longitudinal bore, a breech end opposite said nose, a cup element adjacent said nose and a threaded engagement portion adjacent said breech end, said threaded engagement portion engaging a complimentary threaded inner periphery of said breech plug chamber, said cup element being a deformable seal element in the shape of a circular wall extending forward from a location in front of said threaded engagement portion, said circular wall being sized and shaped to interact with said tapered section of said initial portion to limit said radial movement of a circular free end of said circular wall to thereby form a gas seal between said circular free end of said circular wall and said tapered section of said initial portion to prevent fouling of said threaded engagement portion during firing.

4. A muzzle loading firearm, comprising:

a barrel having a muzzle end and a breech end, and a longitudinal bore having a bore axis and a diameter; a breech plug chamber affixed to said barrel breech end, said breech plug chamber having a rear end and an opposing forward end, an internally threaded engagement portion adjacent said rear end, and an initial portion forward from said internally threaded engagement portion and adjacent said forward end; and a breech plug having a one-piece, integral body adapted to be threadedly received in said breech plug chamber, said breech plug body having:

a nose facing said longitudinal bore; a breech end opposite said nose;

a forward portion adjacent said nose with an outside diameter dimensioned to be received by said initial portion;

a threaded engagement portion adjacent said breech end, said threaded engagement portion engaging said internally threaded engagement portion of said breech plug chamber; and a deformable seal element having an outside diameter having a forward extending cylindrical wall, said deformable seal element having a relaxed position and a deformed position where said outside diameter of said deformable seal element is less than said outside diameter of said seal element when in said relaxed position.

5. The muzzle loading firearm of claim 4, wherein the initial portion including at least one tapered section, wherein when in said relaxed position said outside diameter of said deformable seal element is less than a minor diameter of said internally threaded portion to facilitate passage of said seal element through said internally threaded engagement portion and into immediate contact with said initial portion between a beginning and ending of said tapered portion.

6. A muzzle-loading firearm comprising:

a stock;

a barrel being coupled to the stock, the barrel having a muzzle end and a breech end and defining a longitudinal axis therethrough, the barrel having a rifled inner portion defining lands and grooves and a rifling diameter across the grooves of the rifled portion;

a firing mechanism being movable with regard to the barrel; and a breech plug being located within the breech end of the barrel, the breech plug substantially closing the breech end of the barrel, the breech plug being removable from the breech end of the barrel, the breech plug including:

a first section being configured to receive an applied torque, the first section having a forward facing surface to abut a rearward facing surface of the barrel;

a second section defining a cylindrical body having an external threading along an outer portion thereof, the forward facing surface of the first section defining a forward face diameter being substantially larger than a major diameter of the external threading; and a third section extending forward from a forward surface of the second section, the third section including a cylindrical wall having an outer wall diameter, the cylindrical wall being radially deformable along the longitudinal axis.

7. The muzzle-loading firearm of claim 6, wherein the breech end of the barrel includes an internal threading and a non-threaded surface located forward of the internal threading and an initial portion located forward of the non-threaded surface, the non-threaded surface defining a first diameter, the first diameter being larger than the outer wall diameter, the internal threading being sized and shaped to accept the external threading of the breech plug and to hold the breech plug within the breech end of the barrel during firing of the firearm.

8. The muzzle-loading firearm of claim 7, wherein the first diameter being larger than the rifling diameter of the rifled inner portion.

9. The muzzle-loading firearm of claim 7, wherein the initial portion is in immediate contact with both the non-threaded surface and the rifled inner portion.

10. The muzzle-loading firearm of claim 7, wherein the initial portion includes at least one transition diameter that is smaller than the first diameter of the non-threaded surface and larger than the rifling diameter of the rifled inner portion.

11. The muzzle-loading firearm of claim 6, wherein the breech end of the barrel includes an internal threading and an initial portion, the initial portion being configured to limit radial movement of a front end of the cylindrical wall.

12. The muzzle-loading firearm of claim 6, wherein the outer wall diameter being larger than the rifling diameter.

13. The muzzle-loading firearm of claim 6, wherein the cylindrical wall of the breech plug is sized and shaped to interact with the initial portion of the breech end of the barrel to substantially prevent fowling of the internal and external threading by gases and particles expelled during firing of the firearm.

14. The muzzle-loading firearm of claim 6, wherein the breech plug being removable from the breech end by turning the breech plug from about 10 to about 15 turns.

15. The muzzle-loading firearm of claim 6, wherein the breech plug being a one-piece, integral body.

* * * * *